US011438700B2

(12) United States Patent
Voss et al.

(10) Patent No.: US 11,438,700 B2
(45) **Date of Patent: *Sep. 6, 2022**

(54) ARMATURE AND A TRANSDUCER COMPRISING THE ARMATURE

(71) Applicant: Sonion Nederland B.V., Hoofddorp (NL)

(72) Inventors: Rasmus Voss, Hoofddorp (NL); Wouter Herman Broeze, Hoofddorp (NL); Wouter Bruins, Hoofddorp (NL); Koen van Gilst, Hoofddorp (NL)

(73) Assignee: Sonion Nederland B.V., Hoofddorp (NL)

( * ) Notice: Subject to any disclaimer, the term of this patent is extended or adjusted under 35 U.S.C. 154(b) by 180 days.

This patent is subject to a terminal disclaimer.

(21) Appl. No.: 16/684,750

(22) Filed: Nov. 15, 2019

(65) Prior Publication Data

US 2020/0084548 A1 Mar. 12, 2020

Related U.S. Application Data

(63) Continuation of application No. 15/841,564, filed on Dec. 14, 2017, now Pat. No. 10,516,947.

(30) Foreign Application Priority Data

Dec. 14, 2016 (EP) ..... 16204102

(51) Int. Cl.
*H04R 25/00* (2006.01)
*H04R 11/02* (2006.01)
(Continued)

(52) U.S. Cl.
CPC ..... *H04R 11/02* (2013.01); *H04R 1/02* (2013.01); *H04R 9/06* (2013.01); *H04R 25/00* (2013.01);
(Continued)

(58) Field of Classification Search
CPC ..... H04R 11/02; H04R 2400/11; H04R 7/12; H04R 7/16; H04R 1/28; H04R 1/10;
(Continued)

(56) References Cited

U.S. PATENT DOCUMENTS 6,788,796 B1 9/2004 Miles
6,831,577 B1 12/2004 Furst
(Continued)

FOREIGN PATENT DOCUMENTS

EP 2466915 A3 * 12/2011 ..... H04R 11/02
EP 2466915 A3 6/2012
WO WO 2016/099928 A1 6/2016

OTHER PUBLICATIONS

Extended European Search Report for Application No. 16204102.4, dated Apr. 25, 2017 (3 pages).

*Primary Examiner* — Amir H Etesam
(74) *Attorney, Agent, or Firm* — Nixon Peabody LLP

(57) ABSTRACT

An armature having a U-shaped element having a first leg portion and a second leg portion and an attachment portion. The attachment portion has a first leg and a second leg and a central portion connected to the legs, such as an E-shaped portion, where the first leg portion is connected to the central portion. A transducer can include such armature.

17 Claims, 6 Drawing Sheets

(51) Int. Cl.
*H04R 1/02* (2006.01)
*H04R 9/06* (2006.01)
*H04R 31/00* (2006.01)

(52) U.S. Cl.
CPC ..... *H04R 31/006* (2013.01); *H04R 2209/024* (2013.01)

(58) Field of Classification Search
CPC ..... H04R 1/1008; H04R 1/1058; H04R 1/26; H04R 31/00
See application file for complete search history.

(56) References Cited

U.S. PATENT DOCUMENTS 6,853,290 B2 2/2005 Jorgensen
6,859,542 B2 2/2005 Johannsen
6,888,408 B2 5/2005 Furst
6,914,992 B1 7/2005 van Halteren
6,919,519 B2 7/2005 Ravnkilde
6,930,259 B1 8/2005 Jorgensen
6,943,308 B2 9/2005 Ravnkilde
6,974,921 B2 12/2005 Jorgensen
7,008,271 B2 3/2006 Jorgensen
7,012,200 B2 3/2006 Moller
7,062,058 B2 6/2006 Steeman
7,062,063 B2 6/2006 Hansen
7,072,482 B2 7/2006 Van Doorn
7,088,839 B2 8/2006 Geschiere
7,110,560 B2 9/2006 Stenberg
7,136,496 B2 11/2006 van Halteren
7,142,682 B2 11/2006 Mullenborn
7,181,035 B2 2/2007 van Halteren
7,190,803 B2 3/2007 van Halteren
7,206,428 B2 4/2007 Geschiere
7,221,767 B2 5/2007 Mullenborn
7,221,769 B1 5/2007 Jorgensen
7,227,968 B2 6/2007 van Halteren
7,239,714 B2 7/2007 de Blok
7,245,734 B2 7/2007 Niederdraenk
7,254,248 B2 8/2007 Johannsen
7,286,680 B2 10/2007 Steeman
7,292,700 B1 11/2007 Engbert
7,292,876 B2 11/2007 Bosh
7,336,794 B2 2/2008 Furst
7,376,240 B2 5/2008 Hansen
7,403,630 B2 7/2008 Jorgensen
7,415,121 B2 8/2008 Mögelin
7,425,196 B2 9/2008 Jorgensen
7,460,681 B2 12/2008 Geschiere
7,466,835 B2 12/2008 Stenberg
7,492,919 B2 2/2009 Engbert
7,548,626 B2 6/2009 Stenberg
7,657,048 B2 2/2010 van Halteren
7,684,575 B2 3/2010 van Halteren
7,706,561 B2 4/2010 Wilmink
7,715,583 B2 5/2010 Van Halteren
7,728,237 B2 6/2010 Pedersen
7,809,151 B2 10/2010 Van Halteren
7,822,218 B2 10/2010 Van Halteren
7,899,203 B2 3/2011 Van Halteren
7,912,240 B2 3/2011 Madaffari
7,946,890 B1 5/2011 Bondo
7,953,241 B2 5/2011 Jorgensen
7,961,899 B2 6/2011 Van Halteren
7,970,161 B2 6/2011 van Halteren
8,098,854 B2 1/2012 van Halteren
8,101,876 B2 1/2012 Andreasen
8,103,039 B2 1/2012 van Halteren
8,160,290 B2 4/2012 Jorgensen
8,170,249 B2 5/2012 Halteren
8,189,804 B2 5/2012 Hruza
8,189,820 B2 5/2012 Wang
8,223,996 B2 7/2012 Beekman
8,233,652 B2 7/2012 Jorgensen
8,259,963 B2 9/2012 Stenberg
8,259,976 B2 9/2012 van Halteren
8,259,977 B2 9/2012 Jorgensen
8,280,082 B2 10/2012 van Halteren
8,284,966 B2 10/2012 Wilk
8,313,336 B2 11/2012 Bondo
8,315,422 B2 11/2012 van Halteren
8,331,595 B2 12/2012 van Halteren
8,369,552 B2 2/2013 Engbert
8,379,899 B2 2/2013 van Halteren
8,509,468 B2 8/2013 van Halteren
8,526,651 B2 9/2013 Lafort
8,526,652 B2 9/2013 Ambrose
8,792,672 B2 7/2014 van Halteren
9,357,287 B2 5/2016 Geschiere
2010/0284561 A1 11/2010 Miller
2011/0182453 A1 7/2011 van Hal
2011/0189880 A1 8/2011 Bondo
2011/0299708 A1 12/2011 Bondo
2011/0299712 A1 12/2011 Bondo
2011/0311069 A1 12/2011 Ambrose
2012/0014548 A1 1/2012 van Halteren
2012/0027245 A1 2/2012 van Halteren
2012/0140966 A1 6/2012 Mocking
2012/0155683 A1 6/2012 van Halteren
2012/0155694 A1 6/2012 Reeuwijk
2012/0255805 A1 10/2012 van Halteren
2013/0028451 A1 1/2013 de Roo
2013/0136284 A1 5/2013 van Hal
2013/0142370 A1 6/2013 Engbert
2013/0163799 A1 6/2013 Van Halteren
2013/0195295 A1 8/2013 van Halteren
2016/0227328 A1 8/2016 van Halteren

* cited by examiner

ARMATURE AND A TRANSDUCER COMPRISING THE ARMATURE

CROSS-REFERENCE TO RELATED APPLICATIONS

This application is a continuation of U.S. patent application Ser. No. 15/841,564, filed Dec. 14, 2017, which claims the benefit of European Patent Application Serial No. 16204102.4, filed Dec. 14, 2016, which is incorporated herein by reference in its entirety.

FIELD OF THE INVENTION

The present invention relates to a type of armature where the bending primarily takes place at one end, so that the remainder thereof may be stiff and thus have a more controlled movement of the extreme portion thereof.

BACKGROUND OF THE INVENTION

Armatures made of laminates may be seen in EP2466915, WO2016/099928, U.S. Pat. No. 8,792,672, EP2466915 and US2010/0284561.

In a first aspect, the invention relates to an armature for a moving armature receiver comprising:

a U-shaped element with a first leg, a second leg and a central portion, a flat elongated portion having a first and a second end and defining a plane, the elongated portion extending between the first and second legs, a first and a second sheet extending from the first end, the first sheet having a first portion extending away from the plane on one side of the plane, the second sheet having a second portion extending away from the plane on another side of the plane where the first and second portions are attached to the central portion.

In this context, an armature usually is an element configured to have a portion thereof fastened to e.g. a transducer housing, and to have another, magnetically transmissive or conducting, element thereof extend through a coil tunnel and a magnet assembly airgap and to vibrate in correspondence with a varying current fed to the coil.

SUMMARY OF INVENTION

The armature usually is configured to vibrate. This may be obtained by e.g. providing a portion thereof as a flat elongated portion having a first and a second end and defining a plane. In this connection, an element is flat, if one dimension thereof is smaller, such s 50% or lower, such as 30% or lower, such as 20% or lower, than the dimensions perpendicular (three dimensions perpendicular to each other) thereto. Usually, sheets may be seen as flat elements. Often, flat elements have an upper and a lower surface which are parallel. Often, flat elements are straight, but this is not a requirement. The plane defined by the plane, elongated portion may be a plane parallel with an upper surface or a lower surface of the plane, elongated portion. Alternatively, the plane may be defined by a central portion of the element, such as directly between the upper and lower surfaces.

An elongated element may be an element elongated or extending along a direction, often termed a longitudinal axis, where the extent along that direction is at least 2 times, such as at least 3 times, such as at least 5 times, such as at least 8 times, such as at least 10 times an extent of the element in directions perpendicular to the longitudinal axis.

The first and second sheets extend from the first end. In one embodiment, the first end is attached to the two sheets. In another embodiment, the first and/or second sheets form also at least a part of the flat, elongated portion. Thus, the first and/or second sheets have flat or plane portion(s) forming this part of the flat, elongated portion.

The flat portion may be formed by an element separate from the first and/or second sheets. Then, the first end may be an end of this flat portion. Alternatively, the first end may be a position of the flat portion from which the sheets extend, such as if the sheet(s) form part (one or more) of the same element(s) forming the flat portion.

The first sheet has a first portion extending away from the plane on one side of the plane. In one embodiment, this first portion extends at an angle of at least 45°, such as at least 60°, such as at least 80°, such as at an angle perpendicular to the plane.

The second sheet has a second portion extending away from the plane on another side of the plane. In one embodiment, this second portion extends at an angle of at least 45°, such as at least 60°, such as at least 80°, such as at an angle perpendicular to the plane.

Preferably, these angles are determined when the armature is in a rest position, such as when no other force than gravity affects it.

The armature comprises a U-shaped element with a first leg, a second leg and a central portion. The first and second legs may be the extreme portions of the U-shaped element, and the central portion preferably is positioned between the legs.

The first and second legs may extend at least substantially parallel to each other so as to be attachable to two opposing, parallel inner wall surfaces of a housing.

The central portion may comprise a straight portion, such as configured to be attached to or extend parallel to a plane wall portion at an angle to the directions in which the legs extend. The central portion may also be configured to be attached to a wall portion of a housing wherein the armature is provided.

The first and second sheets are attached to the central portion. Then, the central portion may extend from one side of the plane to the other. Alternatively, the central portion may comprise a first portion on one side of the plane and another portion on another side of the plane.

The elongated portion extends between the first and second legs. Naturally, the portion and the legs need not be present in the same plane. Thus, the portion and legs may have this relation when projected on to the plane. As will be described below, multiple legs may be provided of which some are above and others below the plane. In this projection, the armature is E-shaped, where the U-shaped element forms the "back" and the outer legs of the E and the flat, elongated element forms the middle leg of the E.

In one embodiment, the flat, elongated portion comprises a portion formed by the first sheet also extending from the first end to the second end. In this manner, attachment of the first sheet to this elongated element may be simple. In this situation, that portion of the first sheet is plane.

In that or another embodiment, the flat, elongated portion comprises a portion formed by the second sheet also extending from the first end to the second end.

Actually, the flat, elongated element may be formed by the first and second sheets attached to each other. Naturally, additional elements, such as layers or the like, may be provided to form the flat, elongated portion. Then, an element may be provided between the first and second sheets between the first and second ends.

Then, preferably the first and second sheets are fixed to each other between the first and second ends, as this gives optimal magnetic properties, which are usually desired for armatures for transducers.

As an alternative, the first and second sheets, between the first and second ends, are movable in relation to each other. The sheets may be attached at some point, such as at the second end, in order to have a sufficient control of the relative movement thereof.

In one embodiment, the flat, elongated portion has, at the second end, a bent portion extending in a direction away from the plane. This bent portion may serve as a drive pin. When the flat, elongated portion is made of the first and/or second sheet, only one of these sheets need form the bent portion. This bent portion may be desired quite thin in order to save weight and achieve a good operation.

Naturally, the bendability and structural properties of the armature may be defined by selecting suitable materials and dimensions. The skilled person will know how to achieve the magnetic properties desired.

The bendability primarily is provided in the first/second sheets or the parts thereof extending from the first end and/or between the first end and the first/second portions.

The flat, elongated portion preferably is stiff, whereby it has other properties than the first/second sheets or the parts thereof.

The physical properties may, for a selected material, be affected by selecting e.g. a thickness of the sheets and the flat, elongated portion.

In the present context, the primary target often is to provide a force perpendicularly to the flat surface of the flat, elongate element. This force may be perpendicular to the plane. The plane may bend, if the flat, elongate element bends.

A bending strength or stiffness of the flat, elongate portion may be obtained by a sufficient thickness along the direction of the applied force. However, also an embossing of a groove extending in the direction of the force, for example, may be used for increasing the bending stiffness without affecting the weight. In this situation, the plane will be along a general direction of the width of the flat, elongate portion.

In one embodiment, the flat, elongated portion has a first thickness, in a direction perpendicular to the plane, and the first and second sheets each have a lower thickness. In this situation, the thickness of the first/second sheet may be perpendicular to a surface thereof.

The material properties may be adapted to the desired use. The magnetic properties, such as magnetic conductivity, may be selected in the flat portion, such as one or more layers thereof, to be sufficient to guide a magnetic field generated along the flat portion. The dimensions, such as in a plane perpendicular to a longitudinal direction of the flat, elongated portion, such as a width and/or a thickness of the first/second sheets may be adapted to a stiffness of the material in order to obtain a desired bendability/deformability. A thickness of 40-400 μm may be desired, and the material may be e.g. a soft magnetic material, such as an Iron-Nickel alloy. If the flat portion is made of a laminate comprising multiple magnetically conductive layers, such layers may be attached directly to each other or via a magnetically conducting element in order to provide a high magnetic conductivity along the flat portion and into at least one of the first and second sheets.

Naturally, the first and second sheets may be made of different materials and/or have different dimensions, such as thickness and/or width. In one embodiment, only one of the first and second sheets has a magnetic conductivity above a predetermined threshold.

In one embodiment, the flat, elongated portion has a first width, in the plane, and wherein the first and second sheets each have a second and third width, respectively.

The widths of the first/second sheets will affect the bending properties. Also, wide sheets prefer to bend around an axis parallel with the large surface of the sheets. Thus, the large surfaces of the sheets preferably are provided so that a normal to the large surfaces extend within a plane comprising the longitudinal axis of the plane, elongate element and being perpendicular to the plane of the plane, elongate element.

Naturally, the widths of the first/second sheets will affect also the bendability and may be taken into account when dimensioning the first/second sheets.

Naturally, the widths of the first/second sheets may be varied along a length thereof between the first position and the first/second portions in order to also in this manner affect the bendability and magnetic properties.

In one embodiment, the plane, elongated element has a first width, such as perpendicular to a longitudinal direction thereof and when projected on to the plane. This width may be 0.1-10 mm, such as 0.3-5 mm, such as around 2 mm. Then, the first and/or second sheets may have, at least in a vicinity of the first end, a width being within 10% of the width of the plane element. Alternatively, the first and second sheets may have a combined width (the widths added to each other) within 10% of the width of the plane element.

The U-shaped element may have a single leg on either side of the flat, elongated portion. Alternatively, multiple legs may be provided on either side. In one embodiment, the first and second sheets may be shaped to form the legs.

Thus:

- the first sheet may have a first portion a first and a second extreme portion and a first central part between the first and second extreme portions, the first central part extending away from the first plane on one side of the first plane, and
- the second sheet may have a second portion having a third and a fourth extreme portion and a second central part between the third and fourth extreme portions, the second central part extending away from the first plane on another side of the first plane.

Then, the first, second, third and fourth extreme portions may be legs and then used for fastening inside a transducer housing, such as when:

- the first and third extreme portions are fastened to the first wall portion defining a second plane being at a first angle to an axis in the first plane and being perpendicular the longitudinal axis and
- the second and fourth extreme portions are fastened to the second wall portion defining a third plane being at a second angle to the axis.

In this context, the U-shaped element may be formed by the extreme portions and the central parts.

It is noted that the first and second sheets are connected to the central parts outside of the first plane. This is generally a preferred manner, as this allows the bending of the first and second sheets to perform their operation.

Preferably, the first and second angles are around 90 degrees, such as when projected on to the first plane.

A second aspect of the invention relates to a moving armature receiver comprising:

an armature according to the first aspect of the invention, a magnet assembly comprising at least one magnet and defining an air gap, a coil defining a coil tunnel, two opposing wall portions, the armature extending through the coil tunnel and the air gap, the first and second legs fixed to the opposing wall portions.

In this context, a moving armature receiver is a sound provider having therein an armature which is made to vibrate. The usual manner of having the armature vibrate is to provide a magnet assembly comprising at least one magnet and defining an air gap as well as a coil defining a coil tunnel and to have the armature extend within the coil tunnel and the air gap. Varying a current fed to the coil will vibrate or move the armature within the air gap.

Usually, the portion of the armature extending within the air gap is the flat, elongate element. Any portion of the armature, such as the flat, elongate element, may extend through the coil. In many embodiments, the coil tunnel and the air gap co-extend so that a straight element may extend through both.

The armature is fixed to the opposing wall portions, which often form part of an inner surface of a housing of the receiver.

In one embodiment, the receiver further comprises a diaphragm dividing the housing into two chambers, the diaphragm being connected to the flat, elongate portion of the armature. Usually, the diaphragm would extend in a plane parallel to a longitudinal axis of the flat, elongate portion or the plane thereof.

Often, the diaphragm is connected to the flat, elongate element at the second end thereof, such as via the above, bent portion.

The two chambers of the housing usually are called a front and back chamber. Often, a sound input or output is provided from the surroundings and into one of or both chambers.

In one embodiment, the wall portions extend essentially perpendicular to the plane of the plane, elongate element. Then, the wall portions are preferably at least substantially perpendicular to the plane, elongate element, at least when in a rest position.

Another aspect of the invention relates to a transducer comprising a wall portion and an armature for a moving armature receiver comprising:

a flat elongated portion having a first and a second end and defining a first plane, a first and a second sheet extending from the first end, the first sheet having a first portion extending away from the first plane on one side of the first plane, and the second sheet having a second portion extending away from the first plane on another side of the first plane, where:

the first plane is at an angle to a second plane defined by the wall portion and the first and second portions are fastened to the wall portion.

Thus, the flat, elongated portion of the first aspects of the invention may be attached to a transducer in a different manner. Thus, the considerations and embodiments described above may be equally valid in relation to this aspect of the invention.

In this situation, the wall portion may be a portion of an inner surface of a housing of the transducer and/or a surface portion of an element within a chamber of the transducer, such as a PCB, the magnet stack, the coil or the like.

The wall portion defines a second plane which is at an angle to the first plane defined by the flat, elongated portion. Often, this angle is 90 degrees, but it may be any non-zero angle.

In one situation, a longitudinal axis may be defined in the first plane and between the first and second sheets—and extending between the first and second ends. Then, this axis extends inside the flat, elongated portion and along its length. Preferably, this axis intersects the second plane in a single point. Preferably, this axis is 90 degrees to the second plane.

Naturally, the armature may comprise a fastening portion via which the first and second portions are fastened to the wall portion. This fastening portion may e.g. be as the above central portion of the U-shaped element. The fastening portion may be a plane element configured to be positioned adjacent to a plane wall portion and fastened thereto, such as using welding, soldering, gluing, press fitting or the like.

Again, the first and second sheets preferably are fastened to the wall portion above and below, respectively, the plane.

Naturally, the transducer may further comprise the above-described diaphragm, coil, magnet(s) and the like in order to be able to act like a sound generator or microphone.

Yet another aspect of the invention relates to a transducer comprising a housing and an armature, where:

the armature comprises:

a flat elongated portion defining a longitudinal axis, having a first and a second end and defining a first plane, and one or more fastening portions attached to the housing, where a waist portion is provided between the flat elongated portion and each fastening portion, each waist portion and fastening portion being positioned outside of a second plane comprising the longitudinal axis and being perpendicular to the first plane.

In this context, the flat, elongated portion and the first plane may be as described above. Thus, all above-mentioned embodiments and considerations are equally valid in relation to this aspect of the invention. Naturally, all embodiments of the invention may be combined if desired.

The second plane is a plane wherein the flat, elongated portion moves when vibrating. The longitudinal axis may remain in the second plane during vibration of the flat, elongated portion.

The fastening portions may be portions may be a fastening element for attachment to a wall surface of the housing or multiple fastening elements, such as the above legs, for attachment to multiple surfaces of the housing.

The advantage of having a waist portion outside of the second plane is that the bending or deformation of the armature is again more well defined in that the waist will provide a natural bending position. This bending position will be outside of the second plane, so that this waist portion may be a torsion hinge defining the point around which the armature rotates.

Preferably, at least two waist portions are provided, one on either side of the second plane. Preferably, waist portions are provided in a mirrored fashion around the second plane so that one waist portion has a corresponding waist portion, where the two waist portions at least substantially overlap when projected on to the second plane. Two waist portions may define between them a rotation axis which is perpendicular to the second plane. One such axis may be obtained, which may exist in the first plane, when the waist portions are provided in the first plane. This may be the situation if the waist portions are provided in elements extending in the first plane, perpendicularly to the second plane from the flat, elongated portion to the fastening positions.

If four waist portions are provided, all waist portions may be outside of both the first and second planes, where one waist portion is above both planes, one is below one plane and above the other plane, one waist portion is above one plane and below the other, and the last waist portion is below both planes.

In this situation, pairs of waist portions may define rotation axes perpendicular to the second plane. If an armature is used as described above with the first and second sheets, one rotation axis may be defined for the first sheet and one for the second sheet. Then, each sheet may comprise two portions extending away from the second plane and wherein the waists are provided.

In this context, a waist portion may be a portion which is narrower than neighbouring portions. Thus, between the flat, elongated portion and the fastening portion(s), the armature may have a general width or thickness, where the waist is defined as a narrower or thinner portion.

A narrower or thinner portion may be a portion which has a width or thickness of no more than 90%, such as no more than 80%, 70%, 60%, 50%, or even no more than 40%, of a mean width/thickness of the portions of the armature between the flat, elongated portion and the corresponding fastening portion.

Naturally, a waist may alternatively be generated by having a portion which is softer than surrounding portions. As described above, the softer portion may have a stiffness no more than 90% (80% or lower) of a mean stiffness of the portions between the flat, elongated portion and the corresponding fastening portion.

If the portion comprising the waist is a multilayer element, the waist may be provided in one or more of these layers. The waist will affect the overall, effective thickness/width/stiffness even if present in only one of a plurality of layers.

In one embodiment, the armature is made of one or more sheet-shaped elements with the same thickness in the flat, elongated part, and where the waist is a narrowed portion thereof extending away from the flat, elongated portion.

In the above embodiments, the first and second sheets extend away from the first plane. In this situation, the waist portions may be provided in such sheets—as long as they are away from the second plane.

In another situation, the present armature may have elements extending within the first plane but away from the second plane. Then, the waist portions may be provided in such extending portions.

Preferably the armature is not attached to the housing at positions between the flat, elongate portion and the fastening portions, so that the waist portion(s) are allowed to act as rotational joints.

A final aspect of the invention relates to an armature comprising:

- a U-shaped element having a first leg portion and a second leg portion,
- an attachment portion having at least a first leg and a second leg and a central portion connected to the legs, where the first leg portion is connected to the central portion.

The first leg portion may form at least part of the flat, elongated portion as described in the above aspects.

In one embodiment, the attachment portion is E-shaped having two outer legs and a central portion comprising a central leg, which is then connected to the first leg portion. Then, the flat, elongated portion may be a laminate as described above.

In general, all considerations and embodiments above are equally valid in relation to this aspect of the invention.

The first and second legs may be at least substantially parallel and thus be configured to be attached to two parallel inner walls of a transducer.

The first and second leg portions may be at least substantially parallel. The first leg portion may form the vibrating leg of the armature and the second leg portion may be configured to engage or even be attached to an inner surface of the transducer. Then, a distance between the leg portions may define a distance from the inner surface to the vibrating armature portion.

Thus, when the second leg portion engages a bottom of the transducer housing and the two legs inner, parallel surfaces of the housing, the position of the armature is well-defined in the housing.

The connection between the first leg portion and the central portion may be a glued/welded/soldered connection.

Naturally, the present armature may be provided in a transducer as described above with magnet(s), coil, membrane and so on.

BRIEF DESCRIPTION OF THE DRAWINGS

In the following, preferred embodiments will be described with reference to the drawing, wherein.

DETAILED DESCRIPTION OF THE INVENTION

Figure 1:
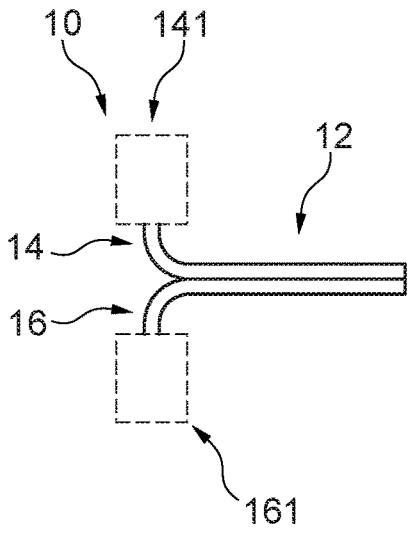
FIG. 1 illustrates a first embodiment of an armature according to the invention.

In FIG. 1, an armature 10 is illustrated being made from a first sheet 14 and a second sheet 16. The sheets are attached to each other along an at least substantially straight, flat portion 12 but flare away from each other to the left. In the extreme left-most portions of the sheets, fastening elements 141/161 are illustrated. These elements or portions may be attached to a structural element, such as a housing, in any desired manner, such as using screws, welding, soldering, glue, press-fitting or the like. In this embodiment, the fastening elements 141/161 comprise a portion of the sheets 14/16 which extend perpendicularly to a first plane defined between the sheets 14/16 in the portion 12 (a plane out of the drawing). Thus, the fastening elements 14/161 may be attached to e.g. a wall perpendicular to this plane.

It is seen that the portion 12 is thicker and therefore stiffer than the flaring portions, so that when the armature is forced upwardly or downwardly, the main bending will take place in the flaring portions.

Figure 2:
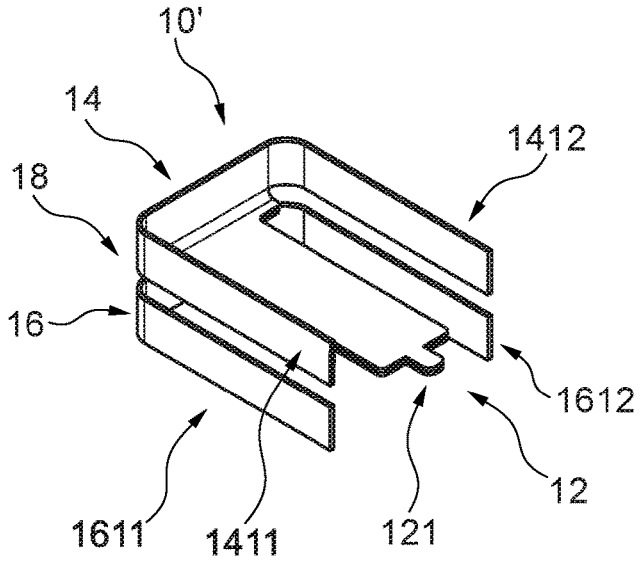
FIG. 2 illustrates a second embodiment of an armature according to the invention.

In FIG. 2, another embodiment 10' is seen, still comprising the first and second sheets 14/16 but now connected to a solid portion 12. The sheets 14/16 still flare upwardly and downwardly, respectively, in relation to a plane defined by the flat portion 12, but now the sheets 14/16 extend not only perpendicularly to the plane of the portion 12 but also bend further to have extreme portions or legs 1411/1412/1611/1612 extending in a direction parallel to a direction of the portion 12. Thus, an armature with a general shape of so-called E-shaped armature is obtained with a central portion 18 interconnecting the portion 12 with the legs. Then, the armature may be fixed to any of a surface perpendicular to a longitudinal axis of the portion 12 or surfaces parallel thereto and perpendicular to the plane of the portion 12.

The outermost portion 121 of the portion 12 may be used for engaging e.g. a drive pin attached to a diaphragm.

Figure 10:
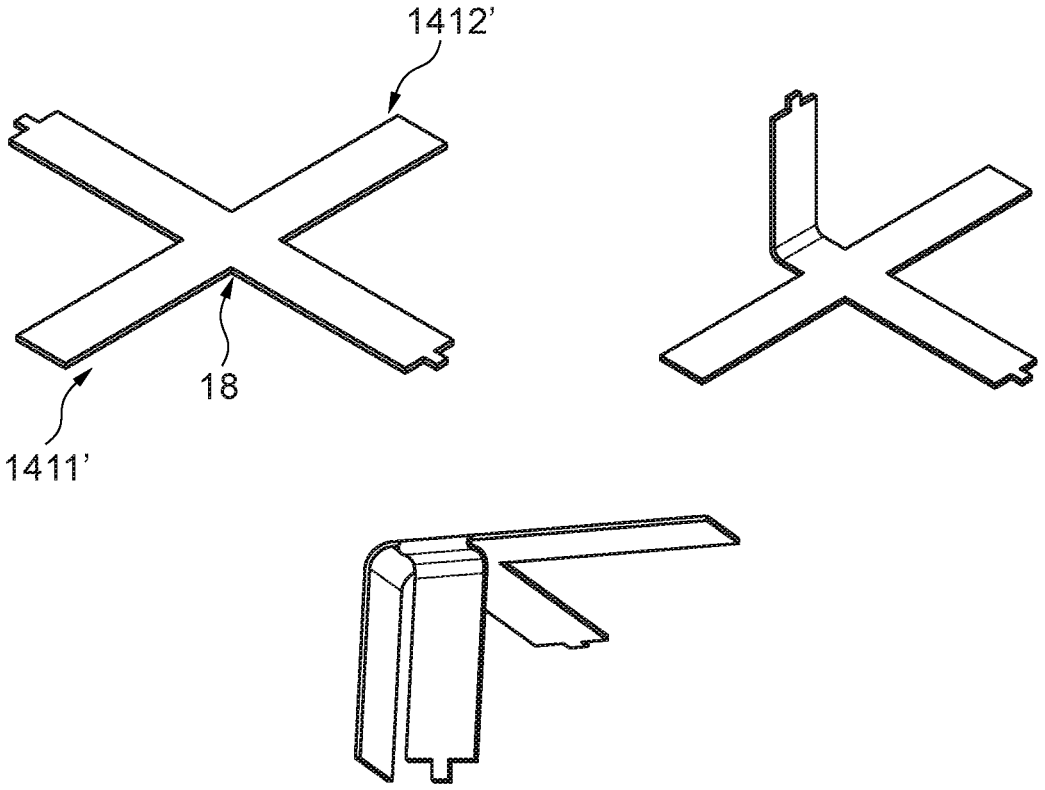
FIG. 10 illustrates how to arrive at the embodiment of FIG. 9

An alternative E-shaped armature is seen in FIG. 10, which may be made of a single sheet of material and which again illustrates the flat, elongated portion 12, the outer portion 121 for the drive pin, the first and second sheets 14 and 16 which are now attached to a U-shaped element formed by the legs 1411' and 1412' and a central portion 18 from which the legs 1411' and 1412' extend. It is seen that the sheets 14 and 16 extend to the upper and lower edges of the central portion 18.

Figure 9:
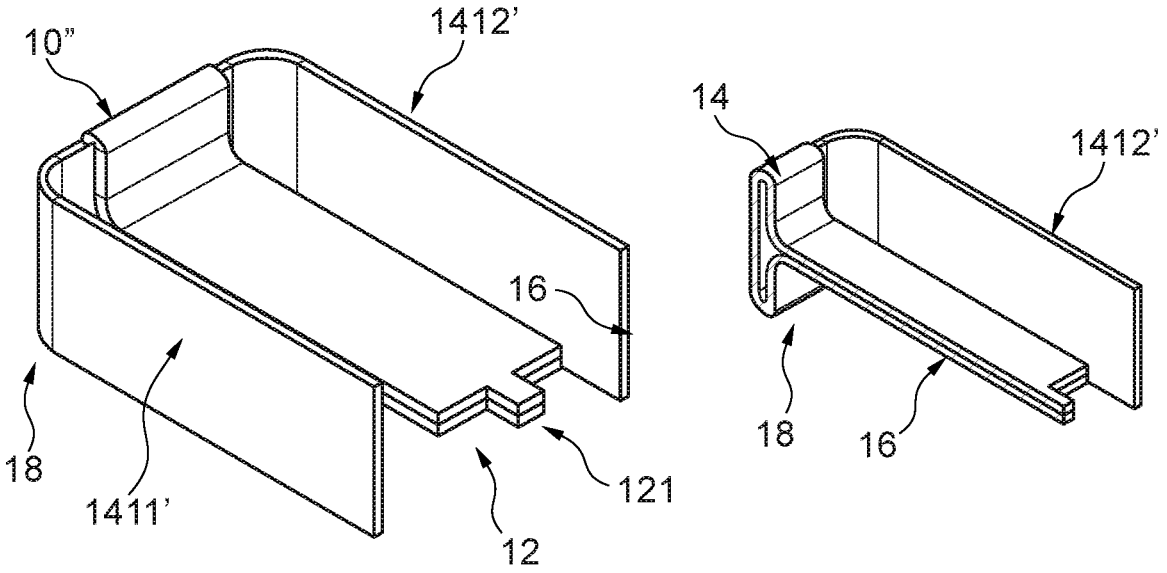
FIG. 9 illustrates another embodiment of an armature according to the invention.

FIG. 9 illustrates how to arrive at the armature of FIG. 10 by initially providing a flat, X-shaped element and then bending it.

Naturally, only the legs may be attached to the housing. Alternatively only the central portion. Also, both the legs and central portion may be attached to the housing if desired.

The armature may of course be made with a wide variety of dimensions. When used in a hearing aid receiver, the overall length of the extreme portions 1411/1412/1611/1612/1411'/1412' may e.g. be 4-7 mm and the width thereof (perpendicular to the plane of the flat portion 12) of 0.5-3 mm, such as 1.5 mm.

Figure 3:
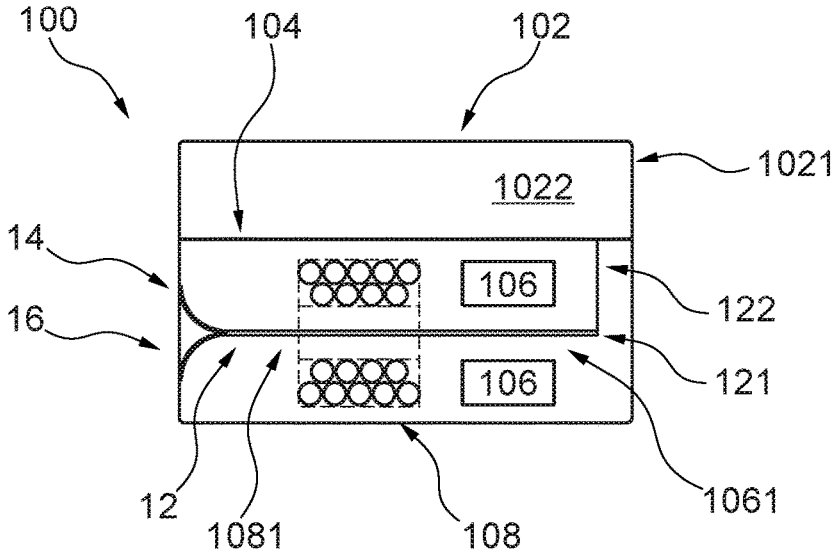
FIG. 3 illustrates a transducer comprising an armature according to the invention.

In FIG. 3, an armature according to the invention is provided inside a housing 102 together with a coil 108, having a coil tunnel 1081, and a magnet assembly 106 having an air gap 1061. Also provided is a diaphragm 104 dividing the housing interior into two chambers, an upper chamber 1022 and a lower chamber. One or more sound inputs/outputs 1021 may be provided anywhere and in any or both chambers.

The sheets 14/16 are attached to one or more housing walls, and the portion 12 extends through the coil tunnel 1081 and the air gap 1061. The extreme portion 121 is attached to a drive pin 122 attached to the diaphragm 104 to transfer movement of the diaphragm to the armature or vice versa.

When the sheets 14/16 are thinner than the portion 12, the bending of the armature is primarily handled by the sheets 14/16, whereby the portion 12 may stay straight, thus generating a more foreseeable translation of the movement caused by the magnets to the diaphragm—or vice versa.

Figure 4:
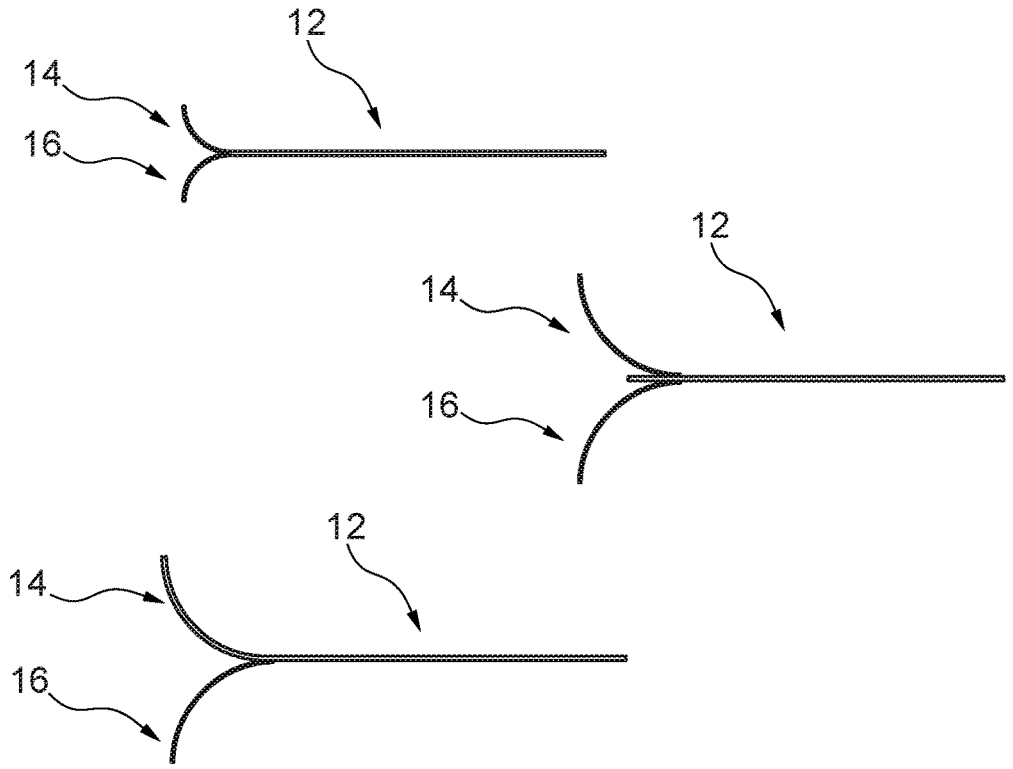
FIG. 4 illustrates different manners of manufacturing an armature according to the invention

In FIG. 4, three different manners of manufacturing the armature may be seen.

In the upper illustration, the two sheets 14/16, as in FIG. 1, co-extend and form also the portion 12. The two sheets may, in the portion 12, be fastened to each other, such as by gluing, press-fitting, welding, soldering, gluing or the like.

Naturally, if the thickness of the portion 12 is desired thicker than the combined thicknesses of the sheets 14/16, a further sheet may be added to the portion 12, such as between the sheets 14/16 or on top thereof (or below these).

If the thickness of the portion 12 is desired thinner than the combined thickness of the sheets 14/16, the sheets 14/16 may be provided thinner (rolling or the like) at the portion 12, or the sheets may, in the bent region, be laminated by additional layers.

In the centre drawing, the portion 12 is made of a separate element, where the two bent sheets 14/16 are attached at one end to the portion 12. Thus, the sheets 14/16 and the element may be made of different elements, and the thicknesses thereof selected freely.

In the lower drawing, the upper sheet 14 forms also the portion 12. The lower sheet 16 thus may extend merely from the fastening (extreme left portion) to a position where it is fastened to the portion 12 or the intersection between the bent portion and the portion 12.

Figure 5A:
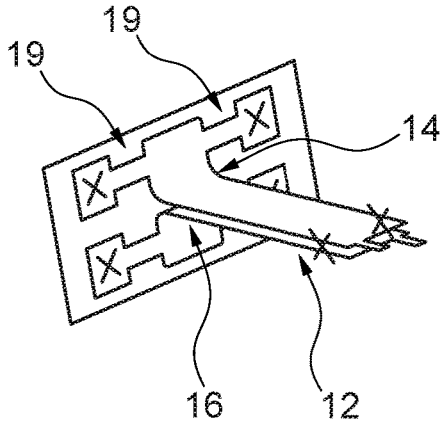
FIGS. 5A, 5B, and 5C illustrate additional embodiments of an armature according to the invention.
Figure 5B:
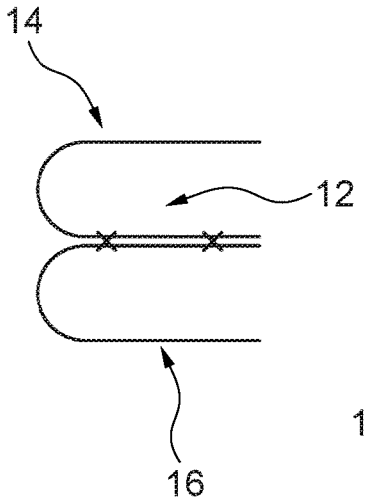
Figure 5C:
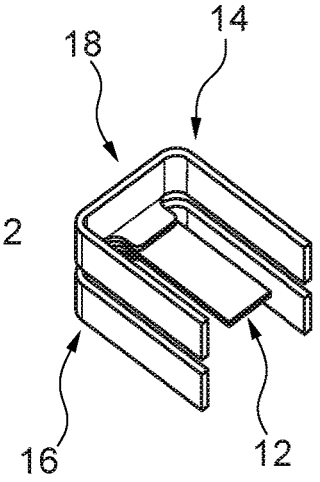

In FIGS. 5A-5C, additional embodiments are illustrated. In FIG. 5A, two bent elements each forms one of the sheets 14/16 and are to the left attached (x'es) to a surface and at the opposite ends (right) attached to each other. In this embodiment, waist portions 19 are provided which define the points of rotation or deformation of the armature. Thus, torsional bending takes place. The two upper waist portions are defined in sidewardly extending portions of the sheet 14 and thus together define a rotation axis extending through the two waists. Thus, the overall bending of the sheet 14 is a rotation at the waists and thus around this axis. The same is the situation for the lower sheet 16.

In FIG. 5B, two sheets 14 and 16 are each bent to a U-shape and attached to each other (x'es) to form an E-shaped armature. This armature is to be attached to an upper and a lower surface of the transducer.

In FIG. 5C, two sheets 14 and 16 are each bent and connected to a separate portion 12 forming the vibrating portion of the armature. The sheets 14 and 16 are attached as illustrated in the central portion of FIG. 4, but the overall armature is now E-shaped as seen in FIG. 2.

FIGS. 6A-6I illustrate a number of alternative embodiments of U-shaped armatures.

Figure 6A:
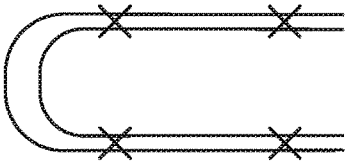
FIGS. 6A, 6B, 6C, 6D, 6E, 6F, 6G, 6H, and 6I illustrate alternative types of U-shaped armatures.

In FIG. 6A, a U-shaped armature is illustrated formed of two U-shaped sheets, one within the cavity of the other, and which are attached (x'es) to have stiffer leg portions than the U-shaped (bottom) deformation portion where a distance exists between the sheets.

Figure 6B:
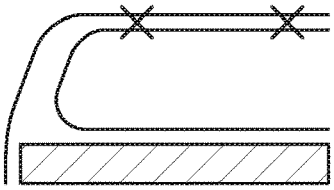

In FIG. 6B, the lower sheet is U-shaped and the upper sheet L-shaped. A leg of one sheet is attached to one of the other. The lower leg of the U-shaped sheet may be attached to a structural element (hatched element), as may the extreme portion of the leg of the L-shaped sheet not attached to the U-shaped sheet. In this manner, the upper legs may be stiffer, as they are attached to each other, so that at vibration, the deformation is handled by the bottom of the U-shaped sheet and the other leg of the L-shaped sheet.

Figure 6C:
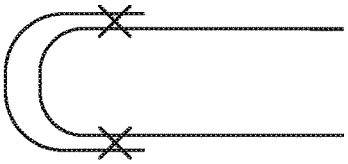

In FIG. 6C, two U-shaped sheets are provided, where the legs of one sheet is attached to the legs of the other but at positions close to the bottom thereof. Thus, the actual legs of the armature are formed of only one sheet, whereas the bottom thereof is formed by the two sheets in unison.

Figure 6D:
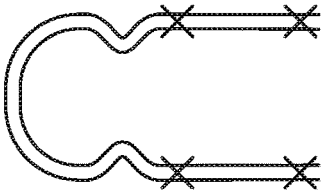

In FIG. 6D, a more complex shape of a U-shaped armature is seen. Again, two congruent sheets are seen, one within the other, and which are attached to each other in the legs in order to become stiffer and/or to obtain better magnetic properties. Between the leg portions and the bottom, the sheets have bends increasing the flexibility of these portions so that the legs may remain straight when vibrated.

Figure 6E:
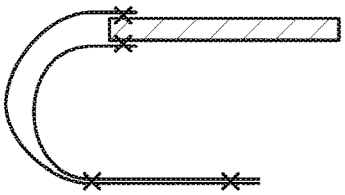

In FIG. 6E, an armature is seen formed of two sheets each forming one leg and the bottom of a U-shape. The legs of the sheets are attached to each other and between the opposite ends of the sheets, a separate element is attached, forming the other leg of the U. Thus, the bottoms of the sheets may again form a deformation or bending portion where the leg, in this situation the separate element, may remain straight.

Figure 6F:
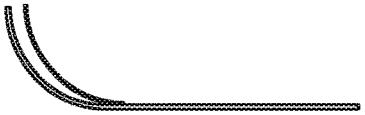

In FIG. 6F, an L-shaped armature is seen formed of two bent sheets. A first sheet forms a bent portion (left) and a straight portion (right) where the right portion forms the vibrating portion extending through the coil and magnet gap. The second sheet is bent in the same direction as the first sheet and attached to the first sheet close to or at the bent portion. Thus, the bent portion of the armature is formed by the two sheets and the leg is formed by one of the sheets only. The upper sheet may e.g. be attached to a cover of the receiver.

Figure 6G:
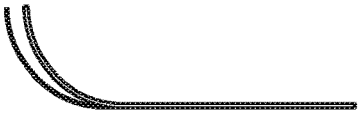

FIG. 6G illustrates an armature as that seen in FIG. 6F, but where the second sheet is provided below the first sheet.

Figure 6H:
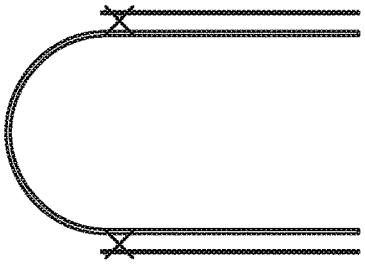

In FIG. 6H, a U-shaped armature is seen formed of an inner U-shaped sheet and two straight sheets each attached to a leg of the U-shaped sheet (x'es) Naturally, the outer sheets may be attached at more than one position or along their full length such as by gluing, welding, press fitting or the like. Thus, the legs of the U-shaped armature are stiffer than the bottom thereof which then will form a bending or deformation portion when a leg is vibrated.

Figure 6I:
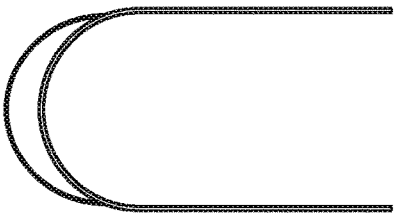

In FIG. 6I, a U-shaped armature is seen formed of two U-shaped sheets, where a first of the sheets forms two straight legs. The other sheet is attached to the bottom or close to the bottom of the first sheet.

In FIGS. 7A-7D, different alternative E-shaped armatures are illustrated.

Figure 7A:
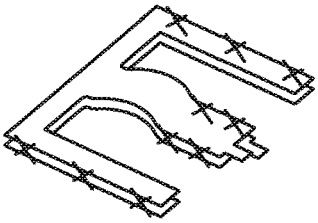
FIGS. 7A, 7B, 7C, and 7D illustrate alternative types of E-shaped armatures.

In FIG. 7A, an armature is illustrated formed by two E-shaped sheets attached to each other (x'es) in each of the arms. The central arm has an upwardly directed (could also be downwardly directed) bend of the two sheets at a position where they are not attached to each other in order to facilitate bending at that position.

Figure 7B:
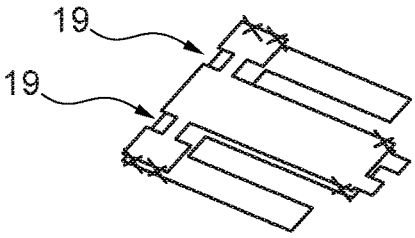

In FIG. 7B, one sheet is E-shaped and the other is T-shaped. The central leg and the stem of the T are attached to each other (x' es) to form a central portion extending through the coil and magnet gap and to have an increased stiffness and/or better magnetic properties. The top portions of the T have waist portions 19 attached at their extremes (x'es) to the E-shaped armature and forming bending or torsion portions facilitating bending or rotation at these positions when the central leg/stem is vibrated. Again, torsional bending takes place so that a rotational axis through the waists is seen. This axis now lies in the first plane.

Figure 7C:
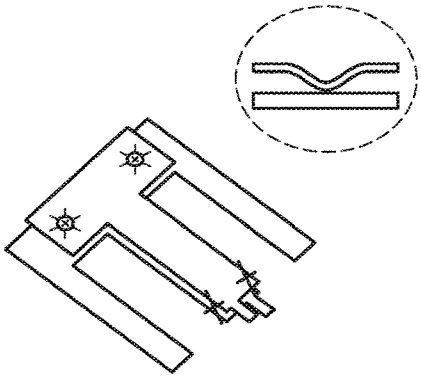

In FIG. 7C, an armature made of an E-shaped sheet and a T-shaped sheet, where the central leg and the stem of the T are attached to each other (x' es). The top portions of the T also are attached to the E-shaped armature (x' es). In the inserted illustration, it is seen that the stem of the T-shaped sheet is contoured and has as downwardly extending depression at which the stem is attached to the central leg. This depression may extend along all of or a main portion of the stem, so as to form an elongate groove, seen from above, in the stem and along the longitudinal axis thereof. This groove or depression increases the stiffness of the stem and thus of the central leg of the E-shaped armature. Then, the portion of the central leg the closest to the base of the E may act as a bending or deformation portion, such as if this portion does not have the depression and thus is formed of two flat sheets.

Figure 7D:
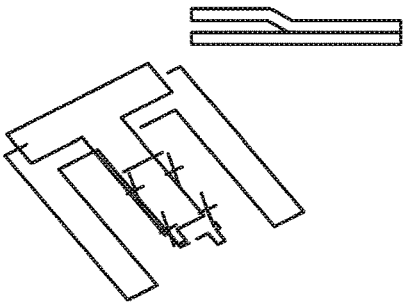

In FIG. 7D, an armature made of an E-shaped sheet and a T-shaped sheet, where the central leg and the stem of the T are attached to each other (x' es). The top portions of the T are not attached to the E-shaped armature. In the inserted illustration, a side view is seen from which it is seen that the stem of the T-shaped sheet abuts the central leg but that a distance exists between the top part of the T and the base portion of the E-shaped sheet. An element may be provided (not illustrated) between the upper and lower layer to generate and fix the distance. The armature with this element may then be attached to the housing, such as between two parts of the housing.

In FIGS. 8A-8D, different alternatives to the embodiment of FIG. 1 are seen as examples of sheet shapes and fastening. These embodiments are viewed along the portion 12 which is seen from the end. In these embodiments, this part is formed by portions of the sheets 14 and 16. Naturally, this is not required for the operation of the bent portions of the sheets 14 and 16. The sheet 14 is illustrated in full lines and the sheet 16 in hatched lines.

Figure 8A:
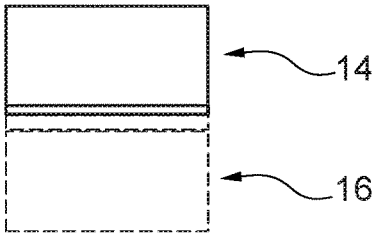
FIGS. 8A, 8B, 8C, and 8D illustrate different sheet widths and fastening manners.

In FIG. 8A, the armature of FIG. 1 is seen where the sheets 14 and 16 have the same width as the portion 12.

Figure 8B:
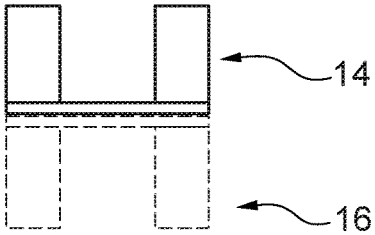

In FIG. 8B, the sheets 14 and 16 are each divided into two portions which may be fastened to the housing.

Figure 8C:
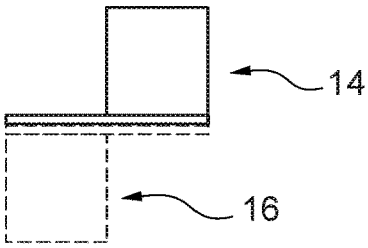

FIG. 8C illustrates an embodiment where the sheets 14 and 16 from the bending region have half the width of the portion 12. Compared to the embodiments of FIGS. 8A, B and D, the bending of this embodiment may be un-symmetrical.

Figure 8D:
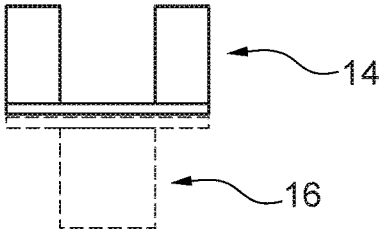

In FIG. 8D, the sheet 16 has a portion with a reduced width provided at the centre of the portion 12 whereas the sheet 14 has two parts as seen in FIG. 8B.

The reduction of the width of the sheets at the bending regions will affect the bending properties. Thus, the bending may be affected not only by the selection of the material of the sheets and the thickness thereof but also the width thereof as well as the relative positions of the bending portions of the sheets.

Figure 11:
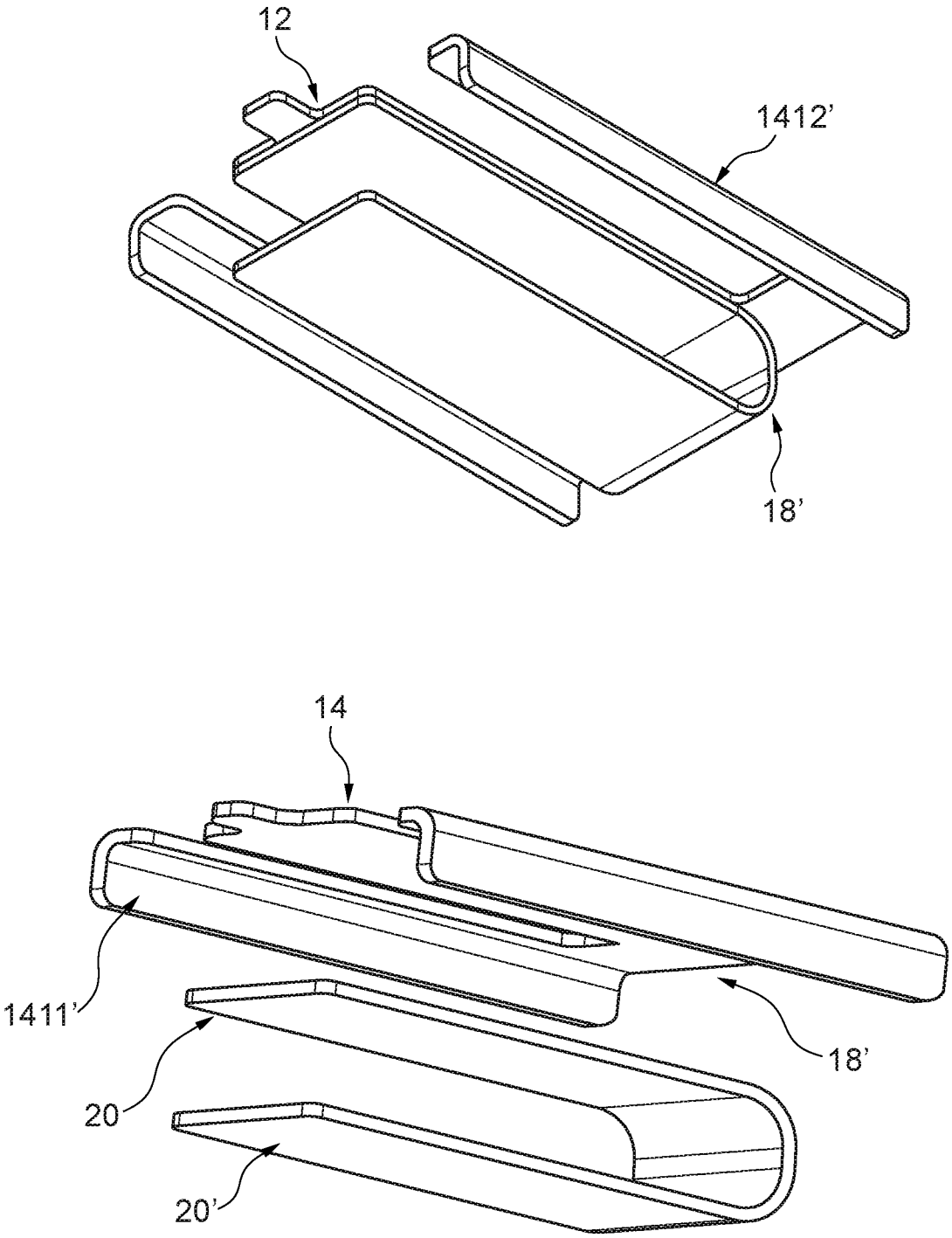
FIG. 11 illustrates another embodiment of an armature according to the invention.

In FIG. 11, another aspect of the invention is illustrated where an E-shaped armature portion is connected to a U-shaped armature portion to arrive at an armature with a laminated central leg, two outer legs and a leg portion which may rest on a bottom of a transducer housing.

The E-shaped portion, or attachment portion, has legs 1411" and 1412" and a central portion having a basis 18' and a central leg.

The U-shaped portion has a first leg portion 20 and a second leg portion 20'. The first leg portion 20 and the central leg are attached to each other to form the flat, elongated vibrating armature leg 12.

Naturally, the central leg may be omitted, such as when the first leg portion 20 is attached to the basis 18'.

In general, the armature may be provided in a transducer housing by having the legs 1411" and 1412" engage opposing wall portions and the leg portion 20' engage a bottom of an inner chamber of the transducer housing. Then, the armature position is well defined. When the legs and leg portion are fixed to the wall portions, the armature is not able to move even when a force is exerted on the portion 12.

The invention claimed is:

1. A transducer comprising a housing and an armature, where:

the armature comprises:

a flat elongated portion defining a longitudinal axis, having a first and a second end and defining a first plane, and one or more fastening portions attached to the housing, where a waist portion is provided between the flat elongated portion and each fastening portion, each waist portion and fastening portion being positioned outside of a second plane comprising the longitudinal axis and being perpendicular to the first plane.

2. An armature for a moving armature receiver comprising:

a flat elongated portion having a first and a second end and defining a plane, the elongated portion extending between the first and second legs, a first and a second sheet extending from the first end, the first sheet having a first portion extending away from the plane on one side of the plane, the second sheet having a second portion extending away from the plane on another side of the plane, and where the first and second portions are attached to the central portion.

3. An armature according to claim 2, wherein the flat, elongated portion comprises a portion formed by the first sheet also extending from the first end to the second end.

4. An armature according to claim 2, wherein the flat, elongated portion comprises a portion formed by the second sheet also extending from the first end to the second end.

5. An armature according to claim 4, further comprising an element between the first and second sheets between the first and second ends.

6. An armature according to claim 4, wherein the first and second sheets are fixed to each other between the first and second ends.

7. An armature according to claim 4, wherein the first and second sheets, between the first and second ends, are movable in relation to each other.

8. An armature according to claim 2, wherein the flat, elongated portion has, at the second end, a bent portion extending in a direction away from the plane.

9. An armature according to claim 2, wherein the flat, elongated portion has a first thickness, in a direction perpendicular to the plane, and wherein the first and second sheets have a second, lower thickness.

10. An armature according to claim 2, wherein the flat, elongated portion has a first width, in the plane, and wherein the first and second sheets have second widths.

11. A moving armature receiver including the armature according to claim 2, and further comprising:

a magnet assembly comprising at least one magnet and defining an air gap, a coil defining a coil tunnel, two opposing wall portions, the armature extending through the coil tunnel and the air gap, the first and second legs fixed to the opposing wall portions.

12. A receiver according to claim 11, wherein the wall portions form part of a wall of a housing wherein the armature, magnet assembly and coil are provided.

13. A receiver according to claim 12, further comprising a diaphragm dividing the housing into two chambers, the diaphragm being connected to the flat, elongate portion of the armature.

14. A receiver according to claim 11, wherein the wall portions extend essentially perpendicular to the plane.

15. An armature comprising:

a U-shaped element having a first leg portion and a second leg portion, an attachment portion having at least a first leg and a second leg and a central portion connected to the legs, where the first leg portion is connected to the central portion, and wherein the attachment portion is E-shaped, wherein the first and second legs form outer legs and wherein the central portion forms a central leg connected to the first leg portion.

16. An armature comprising:

a U-shaped element having a first leg portion and a second leg portion, an attachment portion having at least a first leg and a second leg and a central portion connected to the legs, where the first leg portion is connected to the central portion, wherein the first and second legs are at least substantially parallel and configured to engage inner, parallel surfaces of a housing also having a bottom, and wherein the second leg portion is configured to engage the housing bottom.

17. An assembly comprising an armature and a housing having a bottom and inner, parallel surfaces, the armature comprising:

a U-shaped element having a first leg portion and a second leg portion, an attachment portion having at least a first leg and a second leg and a central portion connected to the legs, where the first leg portion is connected to the central portion, and wherein the first and second legs engage the inner, parallel surfaces and the second leg portion engages the housing bottom.

* * * * *